United States Patent [19]

Revell

[11] 4,061,373

[45] Dec. 6, 1977

[54] DOOR LATCH DEVICE

[75] Inventor: Alan E. Revell, Louisville, Ky.

[73] Assignee: American Air Filter Company, Inc., Louisville, Ky.

[21] Appl. No.: 683,538

[22] Filed: May 5, 1976

[51] Int. Cl.[2] ..... E05C 5/04

[52] U.S. Cl. ..... 292/251; 85/1 K; 292/87; 220/327

[58] Field of Search ..... 292/251, 59, 90, 87; 220/327, 328; 85/1 K

[56] References Cited

U.S. PATENT DOCUMENTS

| | | | |
|---|---|---|---|
| 1,092,651 | 4/1914 | Jordan | 292/87 |
| 1,131,886 | 3/1915 | Wisterman | 292/251 |
| 1,491,394 | 4/1924 | Griffith et al. | 85/1 K |
| 1,589,144 | 6/1926 | Godley | 292/251 |
| 1,636,135 | 7/1927 | Hughes | 292/59 |
| 2,426,842 | 9/1947 | Peavey | 292/251 |
| 2,460,613 | 2/1949 | Whelan et al. | 292/251 |
| 2,991,904 | 7/1961 | Carideo | 292/251 |

FOREIGN PATENT DOCUMENTS

| | | | |
|---|---|---|---|
| 1,124,770 | 3/1962 | Germany | 292/251 |
| 626,013 | 7/1949 | United Kingdom | 292/251 |

*Primary Examiner*—Robert L. Wolfe
*Assistant Examiner*—Kenneth J. Dorner
*Attorney, Agent, or Firm*—Jon C. Winger

[57] ABSTRACT

A door latch device for securing a door in place closing an opening into an enclosure including an elongated resilient retainer strap having an elongated aperture formed in one end and attachable at its other end to the door, a threaded screw-type fastener with a shoulder formed on its shank having its threaded shank extending through the elongated aperture with the shoulder in abutment with one side of the retainer strap, and a latch plate having a concave depression with a centrally disposed threaded aperture therethrough to receive the threaded shank of the screw-type fastener. The screw-type fastener is held in place in the elongated aperture by a resilient toroidally shaped keeper which fits over the shank of the screw-type fastener on the other side of the retainer strap from the shoulder. The latch plate is attachable to the enclosure adjacent the opening to be closed by the door.

7 Claims, 12 Drawing Figures

DOOR LATCH DEVICE

BACKGROUND OF THE INVENTION

The present invention relates to closure fasteners or devices and more particularly to spring arm retracted screw-type fastener door latch devices.

Various screw-type fastener devices are known and may be adequate in most cases to secure a pivotally mounted door over an opening.

However, there are applications which require a door to follow a planar motion toward and away an opening as well as pivot about a hinge point at the beginning or end of its planar motion. Planar motion in this discussion is defined as the motion of a body in which all points of the moving body remain at constant distances from a fixed plane.

SUMMARY OF THE INVENTION

The present invention recognizes the problems of providing a latch fastener for such a door and provides a solution which is straightforward, simple in construction, economical to manufacture, and easy to install and use.

More particularly, the present invention provides a door latch device comprising: (a) a latch mechanism comprising: an elongated resilient retainer having an elongated aperture proximate one end with the longitudinal axes of the elongated aperture being coextensive with the longitudinal axes of the elongated retainer; means for attaching the other end of the elongated retainer to the door; a screw-type fastener having a threaded shank extending through the elongated aperture; manipulating means disposed on one end of the threaded shank; and, means for attaching the screw-type fastener in the elongated aperture and allowing the screw-type fastener to rotate about its longitudinal axis and move along the longitudinal axis of the elongated aperture; (b) a latch plate comprising: means defining a depression in the plate; and means, defining a threaded aperture through the plate in the depression, the threads of the aperture conform to the threads of the screw-type fastener so as to threadably receive the shank of the fastener.

BRIEF DESCRIPTION OF THE DRAWING

A better understanding of the invention will be had upon reference to the specification and the accompanying drawing of a preferred embodiment, wherein like numerals refer to like parts throughout the several views and in which.

DETAILED DESCRIPTION OF THE PREFERRED EMBODIMENT

Figure 1:
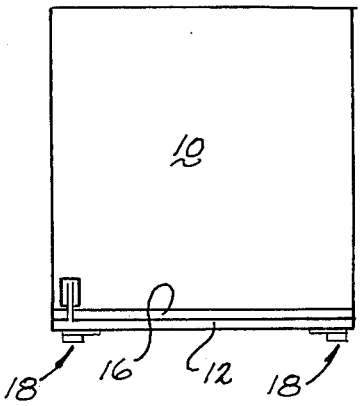
FIG. 1 illustrates a top view of an exemplary enclosure having a door held closed by the latch device of the present invention.
Figure 2:
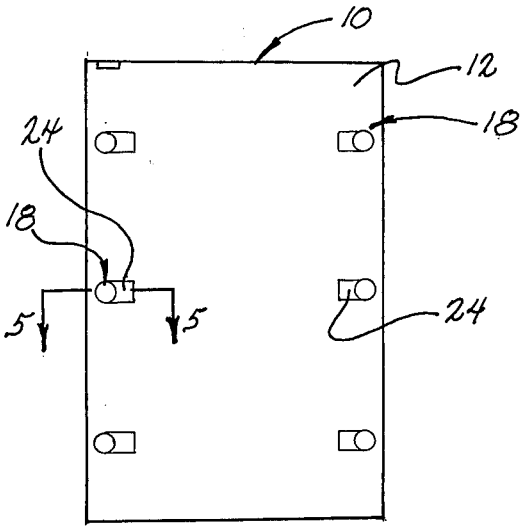
FIG. 2 is a front view of the exemplary enclosure of FIG. 1.
Figure 3:
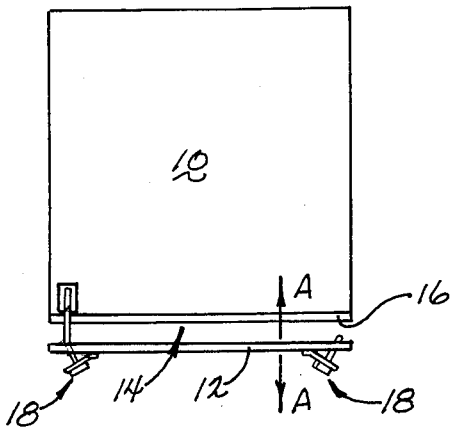
FIG. 3 illustrates a top view of the enclosure of FIG. 1 with the door unlatched.
Figure 4:
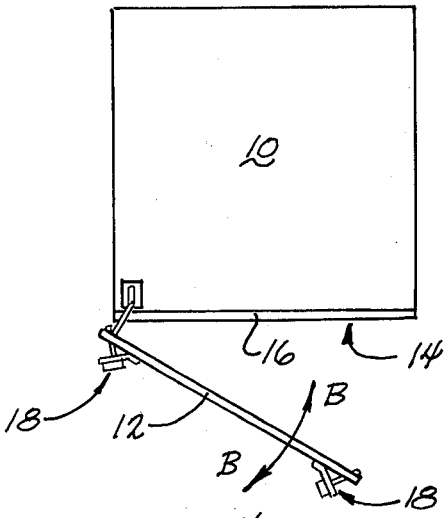
FIG. 4 illustrates a top view of the enclosure of FIG. 3 with the unlatch door pivoted from the opening.

By way of background understanding of an application of the present invention reference is made to FIGS. 1–4 which illustrate an exemplary enclosure, generally denoted as the numeral 10, having a door 12 for closing an opening 14. The enclosure 10 is a pressure vessel, that is, in operation when the door is closed over the opening and there is a pressure differential between the interior of the enclosure and the ambient. In order to maintain this pressure differential, there is a seal 16 around the opening 14 which is compressed by the closed door 12. To maintain an even sealing force around the periphery of the door 12, it is preferable that a plurality of latch devices 18 be used along both edges of the door 12. Further, a door 12 which pivots between a closed position over the opening 14 and an open position would abrade or deform the seal 16 by rubbing against it. To prevent this from happening, a door 12 which moves in a planar motion proximate the opening 12 and pivots to an open position after it has been displaced a distance from the seal 16 is preferred. FIG. 3 represents this planar motion, defined above, by the arrows A—A. To open the door 12 the fastening devices are released and the door 12 is removed from the opening following the planar motion A—A. It is then pivoted to a wider open position as represented by the arrows B—B in FIG. 4. Of course, to close the door 12 over the opening 14 the sequence is reversed, i.e., the door is pivoted from the wide open position illustrated in FIG. 4 to the partially closed position of FIG. 3, and then moved in the planar motion arrows A—A to the closed position of FIG. 1. The latch devices are then made fast, thus, evenly compressing the seal between the door and enclosure.

Figure 5:
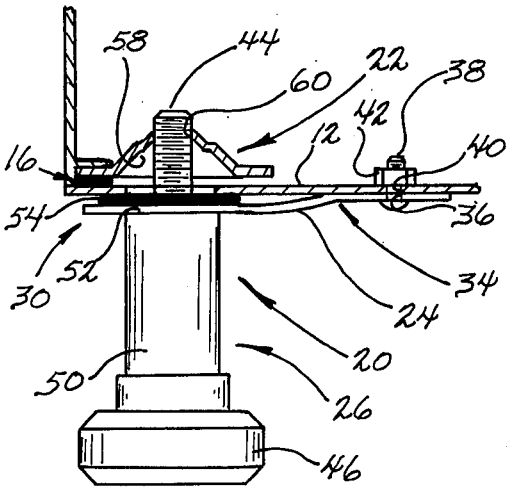
FIG. 5 is an enlarged partial cross-sectional view taken in the direction of arrows 5—5 in FIG. 2; showing the invention in the latched position.
Figure 6:
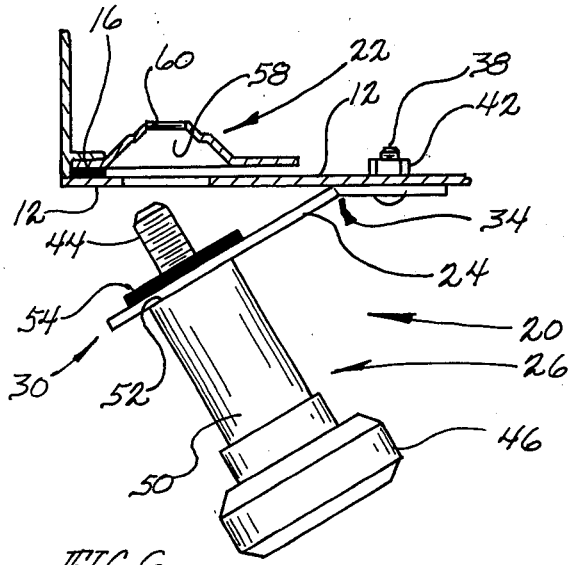
FIG. 6 is an enlarged cross-sectional view similar to FIG. 5 but showing the invention in an unlatched position.

FIG. 5 best illustrates the preferred embodiment of the latch device 18 of the present invention in the latched position and FIG. 6 best illustrates it in the unlatch position. Latch device 18 is comprised of a latch mechanism, generally denoted as the numeral 20, and a latch plate 22.

The latch mechanism 20 is comprised of an elongated resilient retainer strap 24, a screw-type fastener 26, and means 30 for attaching the screw-type fastener 26 to the elongated resilient retainer 24.

Figure 7:
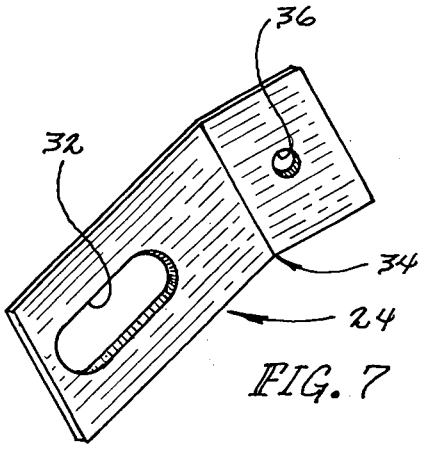
FIG. 7 is an isometric view of one component of the present invention.

As can be seen in FIGS. 5 and 6, but best in FIG. 7, the elongated resilient retainer strap 24 has an elongated aperture 32 formed therethrough proximate one end of the retainer 24, with its longitudinal axis coextensive with the longitudinal axis of the retainer 24. Further, the resilient retainer strap 24 is permanently bent between its ends, as indicated at the numeral 34, to an included angle of approximately 60 degrees between the two end portions of the retainer strap 24. Further, the other end of the retainer strap 24 is adopted to be attached to the door 12 by any conventional or otherwise convenient means. This attachment means is illustrated in FIGS. 5, 6, and 7 as consisting of a hole 36 formed in the other end of the retainer strap 24, a machine screw 38 received through the hole 36 and through an appropriate hole 40 in the door 12, and a nut 42 threadably received on the machine screw 38 on the other side of the door 12 from the retainer strap 24, thus, fastening the retainer strap 24 to the door 12.

In practice, it has been determined that an elongated retainer strap 24 fabricated of a spring steel such as SAE 1064, 1070 or 1074 works well.

Figure 8:
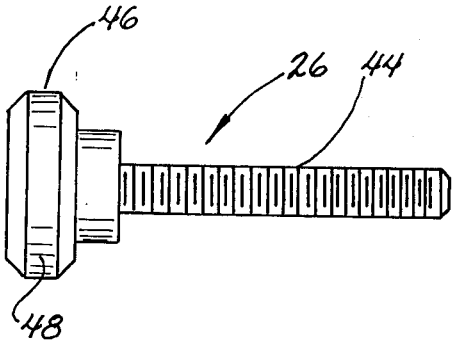
FIG. 8 is another component of the present invention.
Figure 9:
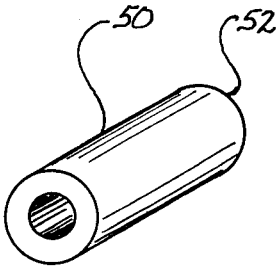
FIG. 9 is an isometric view of yet another component of the present invention.

The screw-type fastener 26 is illustrated in FIGS. 5, 6, and 8, and comprises a threaded shank 44, and manipulating means, such as a knob 46, attached at one end of the shank 44. The knob 46 is formed with gripping ridges 48 to provide a non-slip surface when grasped by a human hand. The diameter of the shank 44 is slightly smaller than the minor dimension or width of the elongated aperture 32 in the retainer strap 24 and is inserted through the aperture 32 such that the knob 46 is on one side of the strap 24 and the threaded shank 44 protrudes from the opposite side of the strap 24.

Figure 10:
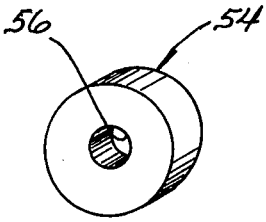
FIG. 10 is an isometric view of a further component of the present invention.
Figure 11:
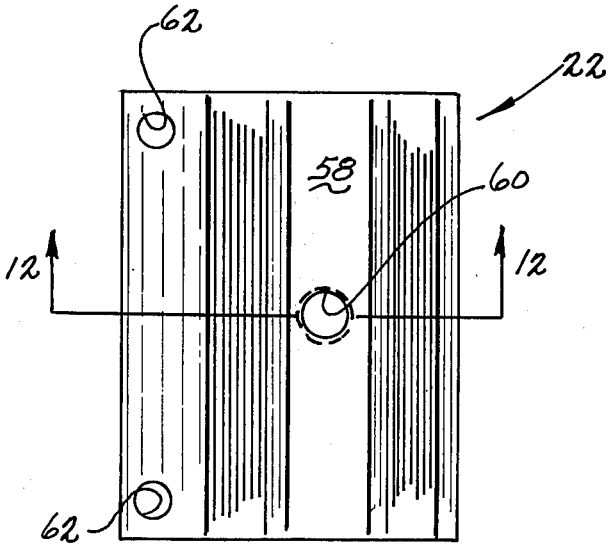
FIG. 11 is a front view of yet another component of the present invention.
Figure 12:
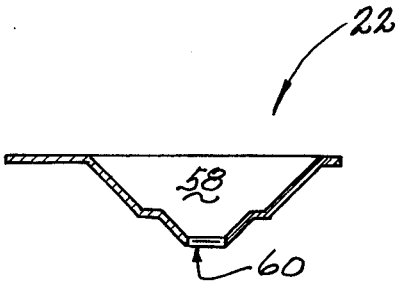
FIG. 12 is a cross-sectional view taken in the direction of arrows 12—12 in FIG. 11.

With reference to FIGS. 5, 6, 9, and 10, the attaching means 30 comprises tubular element 50 coaxially receiving the shank 44 of the screw-type fastener 26 such that one end of the tubular element abuts the knob 46 and the other end of the tubular element forms a shoulder 52. When the threaded shank 44 is inserted through the elongated aperture 32 in the resilient strap 24 the shoulder 52 abuts one side of the elongated resilient strap 24 as can be seen in FIGS. 5 and 6. Further, the attaching means 30 comprises keeper means which is illustrated in FIGS. 5, 6, and 10 as a resilient body 54. The resilient body 54 has an aperture 56 therethrough of a diameter slightly smaller than the diameter of the threaded shank 44. The aperture 56 receives the shank 44 protruding from the other side of the resilient strap 24 from the side thereof in abutment with the shoulder 52. The shank 44 displaces some of the material of the resilient body 54 defining the aperture 56 thereby causing the body 54 to grip the shank 44. Thus, the body 54 cooperates with shoulder 52 to captively hold the resilient strap 24 therebetween, allowing for rotational movement of the screw-type fastener 26 about the longitudinal axis of its threaded shank 44 and for movement of the threaded shank 44 along the longitudinal axis of the elongated aperture 32.

It has been determined in practice that a toroidally shaped body 54 fabricated of a commercial grade solid neoprene having a durometer of 55–65 words well.

With reference to FIGS. 5, 6, 11 and 12, the latch plate 22 comprises a depression 58 and a threaded aperture 60 formed in the depression. The threads of the aperture 16 are compatible with the threaded shank 44 to threadably receive it. The latch plate 22 is adapted to be secured to the enclosure 10 proximate the opening 14 so that the depression 58 concavely faces outwardly of the enclosure 10. Any conventional or convenient securing means can be used, such as, conventional screws received through holes 62 in the plate 22 and fastened in appropriate holes in a wall of the enclosure 10.

It should be noted that to install the latch device 10 on a door 12, an appropriately size shank receiving aperture 64 must be placed through the door 12. The shank receiving aperture 64 must be large enough in diameter to allow the shank 44 of the screw-type fastener 26 to assume about a 30° angle to the axes of the shank receiving aperture 64 as the shank 44 is retracted from the aperture 60 in the plate 22 by the resilient strap 24. When the latch device 18 is in the latched position the resilient body 54 covers the receiving aperture 64 and functions as a seal.

To unlatch the door 12 so that it can be removed from its position closing the opening 14, the screw-type fastener 26 is manually rotated so that the threaded shank 44 retreats from the threaded aperture 60 in the latch plate 22. As the shank 44 clears the threaded aperture 60 the fastener 26 is released and the resilient retainer strap 24 by its springlike action pulls the thread shank 44 away from the latch plate 22 in an arcuate path about the location 34 at which the strap 34 has been permanently bent. The depression 58 in the plate 22 provides clearance for the threaded shank 44 as it moves in the arcuate path so that the shank 44 will not hang up on the plate 22.

To latch the door 12 over the opening 14, the screw-like fastener 26 is manually pushed toward the latch plate 22 against the resilient force of the strap 24, the path of movement being arcuate about the location 34 at which the strap 24 has been permanently bent. At the end of its travel, the threaded shank 44 will be axially aligned with the threaded aperture 60 in the plate 22. The threaded shank 44 is then rotated so that it is threadably received in the threaded aperture 60.

The foregoing detailed description is given primarily for clarity of understanding and no unnecessary limitations should be understood therefrom for modifications will become obvious to those skilled in the art upon reading this disclosure and may be made without departing from the spirit of the invention or the scope of the appended claims:

What is claimed is:

1. A door latch device for securing a door in place over an enclosure defined opening, the door latch device comprising:

a. a latch mechanism comprising:

an elongated resilient retainer having an elongated aperture proximate one end with the longitudinal axis of the elongated aperture being coextensive with the longitudinal axis of the elongated retainer, the end of the elongated resilient retainer having the elongated aperture being disclosed at a predetermined angle to the other end of the elongated resilient retainer;

means for attaching the other end of the elongated retainer to the door;

a screw-type fastener having a threaded shank extending through the elongated aperture in the retainer;

manipulating means disposed at one end of the threaded shank; and, means for attaching the screw-type fastener in the elongated aperture while allowing the screw-type fastener to rotate about its longitudinal axis and move along the longitudinal axis of the aperture comprising:

shoulder means disposed on the shank of the screw-type fastener for abutting one side of the elongated resilient retainer; and, a resilient body keeper means having an aperture therethrough of a smaller diameter than the diameter of the shank of the screw-type fastener, the shank of the screw-type fastener protruding from the other side of the elongated resilient retainer, the shoulder means being coaxially receivable through the aperture in the resilient body keeper means displacing some of the material of the resilient body defining the aperture therethrough thereby causing the resilient body to tightly grip the shank of the screw-type fastener to captively hold the elongated resilient retainer between the resilient body keeper means and the shoulder means;

b. a latch plate securable to the enclosure defining opening comprising:

means defining a depression in the plate; and, means defining a threadable aperture through the plate in the depression, the threads of the aperture conform to the threads of the screw-type fastener so as to threadably receive the shank of the fastener.

2. The door latch of claim 1, wherein the shoulder means comprises a tubular member coaxially receiving the shank of the screw-type fastener, one end of the tubular member defining the shoulder.

3. The door latch of claim 3, wherein the resilient keeper means is generally toroidal in shape.

4. The door latch of claim 5, wherein the generally toroidally shaped keeper means is made of a rubber material having a durometer of approximately 55 to 60.

5. The door latch of claim 1, wherein said elongated resilient retainer comprises a spring steel strap.

6. The door latch of claim 5, wherein the predetermined angle is an included angle of approximately 60°.

7. The door latch of claim 5, wherein the means for attaching the other end of the strap to the door comprises:

means defining a hole through the other end of the strap; and, a screw-type fastener receivable through the hole.

* * * * *

UNITED STATES PATENT OFFICE

CERTIFICATE OF CORRECTION

Patent No. 4,061,373 Dated December 6, 1977

Inventor(s) Alan E. Revell

It is certified that error appears in the above-identified patent and that said Letters Patent are hereby corrected as shown below:

Column 6, line 1, "The door latch of Claim 3" should read ---- The door latch of Claim 2 ----.

Column 6, line 3, "The door latch of Claim 5" should read ---- The door latch of Claim 3 ----.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*